US008950689B2

(12) United States Patent
Urroz

(10) Patent No.: US 8,950,689 B2
(45) Date of Patent: Feb. 10, 2015

(54) BALLAST ANTI-FLIGHT RAILROAD SLEEPER

(76) Inventor: Eduardo Romo Urroz, Madrid (ES)

( * ) Notice: Subject to any disclaimer, the term of this patent is extended or adjusted under 35 U.S.C. 154(b) by 118 days.

(21) Appl. No.: 13/559,367

(22) Filed: Jul. 26, 2012

(65) Prior Publication Data

US 2014/0027525 A1 Jan. 30, 2014

(30) Foreign Application Priority Data

Jul. 27, 2011 (ES) ..... 201100853

(51) Int. Cl.
*E01B 9/14* (2006.01)

(52) U.S. Cl.
USPC ..... 238/80; 238/54

(58) Field of Classification Search
USPC ..... 238/54, 55, 58, 62, 73, 74, 76, 80
See application file for complete search history.

(56) References Cited

U.S. PATENT DOCUMENTS

| | | | | |
|---|---|---|---|---|
| 853,135 | A * | 5/1907 | Switzer et al. | 238/80 |
| 1,001,788 | A * | 8/1911 | Webb | 238/80 |
| 1,048,594 | A * | 12/1912 | Schisler | 238/80 |
| 1,063,471 | A * | 6/1913 | Schisler | 238/80 |
| 1,097,082 | A * | 5/1914 | Cornelius | 238/80 |
| 1,148,353 | A * | 7/1915 | Carney | 238/80 |
| 3,877,640 | A * | 4/1975 | Hemmady | 238/2 |
| 4,203,549 | A | 5/1980 | Sandford | |
| 2012/0248215 | A1* | 10/2012 | Sadeghi et al. | 238/54 |

FOREIGN PATENT DOCUMENTS

| | | | |
|---|---|---|---|
| JP | 9273101 | A | 10/1997 |
| JP | H11280001 | A | 10/1999 |
| JP | 2007126831 | A | 5/2007 |
| WO | W09731154 | A1 | 8/1997 |

* cited by examiner

*Primary Examiner* — Jason C Smith

(74) *Attorney, Agent, or Firm* — Stolowitz Ford Cowger LLP

(57) ABSTRACT

A ballast anti-flight sleeper characterized by having on the upper face two surfaces endowed with sufficient inclination as to prevent the accumulation of ballast over this side of the sleeper, with this geometric topology being the main claim; the fundamental elements in the same figure: track (1), ballast anti-flight sleeper (2), ballast (3) and the elements to anchor and secure the track (4).

18 Claims, 1 Drawing Sheet

BALLAST ANTI-FLIGHT RAILROAD SLEEPER

This application claims priority to Spanish Application No. P201100853, filed on Jul. 27, 2011, which is incorporated herein in its entirety by reference.

BACKGROUND

As higher speeds are introduced in the modern railroad exploitation new undesirable phenomena need to be faced. One of them, associated with very high circulation speeds and some kinds of trains, is known as ballast lifting or ballast "flight" which consists of the mobilization of particles of ballast that, stirred by the train that travels at a very high speed, are pushed away and displaced with respect to their initial position.

SUMMARY

Traditional railroad sleeper characterized by a specific geometric topology consisting of having on the upper face of the main piece of the sleeper two inclined surfaces instead of the usual horizontal surface, which prevents the accumulation of ballast on the upper face of the sleeper, eliminates a subsequent hurling and with this all undesirable associated phenomena.

Figure 2:
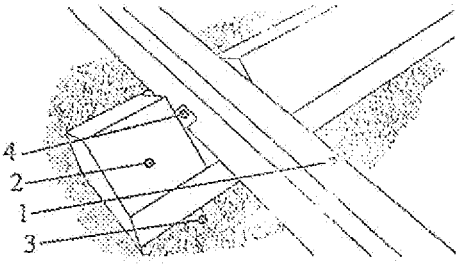

FIG. 2) shows in detail a ballast anti-flight sleeper characterized by having on the upper face two surfaces endowed with sufficient inclination as to prevent the accumulation of ballast over this side of the sleeper, with this geometric topology being the main claim: the fundamental elements in the same figure: track (1), ballast anti-flight sleeper (2), ballast (3) and the elements to anchor and secure the track (4).

DETAILED DESCRIPTION

In accordance with the analysis and experiments carried out, this phenomenon begins with particles, grains of ballast located on the upper part of the sleepers that at the passing of the train, and as a result of the vibrations produced, star flying away dragged by aerodynamic effect and sometimes are propelled to considerable distances In order to avoid the undesirable consequences arising from this phenomenon a sleeper with a specific geometric topology is proposed to prevent the triggering of this phenomenon right on its origin.

To do so a sleeper using a pioneering and specific geometry topology is proposed which is totally compatible with all the usual fabrication materials.

A geometry quite different to that used so far in railroad sleepers. This new geometry would imply to fit on the upper part of the sleeper two inclined surfaces instead of the usual horizontal surface.

These two surfaces, inclined crossway with respect to the section of the sleeper, will prevent the grains of ballast to remain on the upper face of it thus making it impossible for them to be propelled away as a result of the vibrations created by the passage of the axles of high speed trains.

This inclined geometry of the upper part of the sleeper is claimed for monolithic or "monoblock" type of sleepers as well as for those made up by two main pieces, linked or connected by a metallic brace, called "bi-block" sleepers. This geometry is also claimed for sleepers made up of three or more main pieces, connected by lightening elements regardless their fabrication material.

Figure 1:
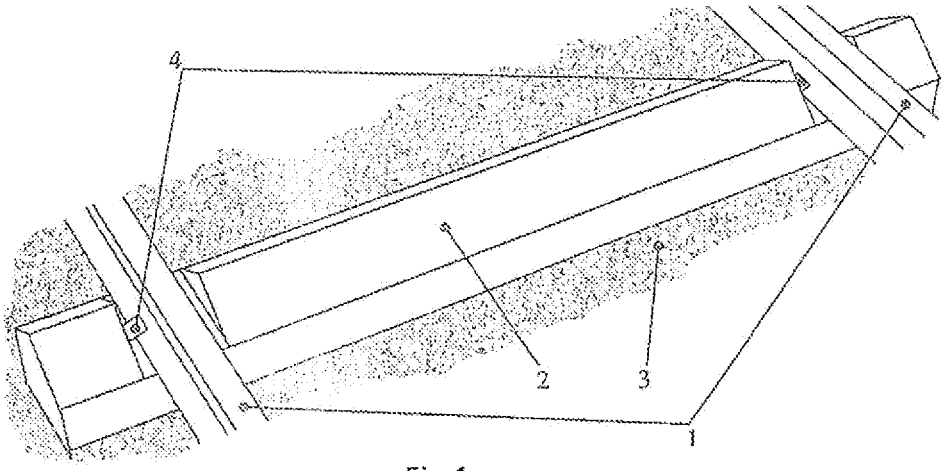

The invention will now be described by means of an example and making reference to the attached drawings, where:

FIG. 1 shows the conventional elements of a railroad sleeper, tracks (1), anti-flight sleeper (2), ballast (3), and railroad sleeper anchorage (4)

The anti-flight sleeper (2) shown has two inclined planes or surfaces on its upper side, rounded off in peak or any convex form that prevents the presence of ballast on the upper face of the sleeper thus eliminating any undesirable phenomenon involving ballast "flight".

Figure 3:
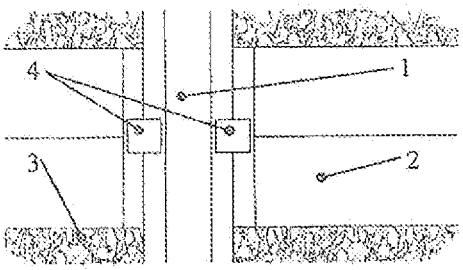
Figure 4:
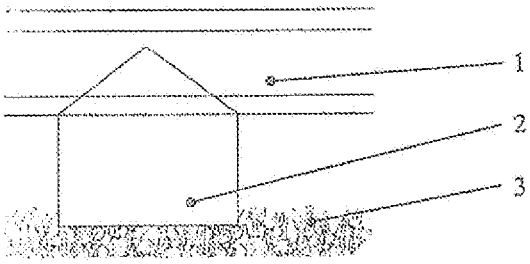

FIGS. 2, 3 and 4 respectively show, from an upper perspective, the base and the profile of half of the anti-flight sleeper, in a symmetrical form with respect to the other half.

The invention claimed is:

1. A railroad sleeper, comprising:

a bottom part having a bottom end for seating on ballast and having a top end with a horizontal upper face configured to support railroad tracks; and an upper part having a bottom end located on the upper face of the bottom part and comprising two surfaces extending up from the horizontal upper face of the bottom part, wherein:

the two surfaces of the upper part are inclined crossway with respect to the bottom part and rounded off in a peak or convex form for preventing the presence of ballast on an upper face of the railroad sleeper, and the railroad tracks sit on the horizontal upper face of the top end of the bottom section and extend up from the bottom end of the upper part.

2. The railroad sleeper of claim 1, wherein the bottom part and the upper part are formed from a unitary piece of material.

3. The railroad sleeper of claim 1, wherein the bottom part and the upper part form a monolithic structure.

4. The railroad sleeper of claim 1 wherein the bottom part and the upper part comprise separate pieces of material.

5. The railroad sleeper of claim 1, further comprising anchorages configured to attach the upper part to the lower part.

6. The railroad sleeper of claim 1, wherein the railroad tracks sit between parts of the upper part.

7. A railroad sleeper, comprising:

a bottom part with a bottom end configured to sit on ballast and a top end with a horizontal upper face configured to support railroad tracks; and an upper part with a bottom end extending up from the upper face of the bottom part and comprising two oppositely inclining top surfaces extending up from the horizontal upper face of the bottom part and forming a peak, wherein the railroad tracks sit on the horizontal upper face of the top end of the bottom section and extend up from the bottom end of the upper part.

8. The railroad sleeper of claim 7, wherein the upper part comprises multiple pieces.

9. The railroad sleeper of claim 8, further comprising anchors located between the multiple pieces of the upper part configured to attach to the railroad tracks.

10. The railroad sleeper of claim 7, wherein the peak formed by the top surfaces comprises a convex shape.

11. The railroad sleeper of claim 7, wherein the bottom part and the upper part are formed from a unitary piece of material.

12. The railroad sleeper of claim 7, wherein the bottom part and the upper part are formed from different pieces of material.

13. The railroad sleeper of claim 7, wherein the bottom end of the upper part is supported above the ballast by the bottom part.

14. Ballast anti-flight railroad sleeper fabricated with conventional materials, comprising:

a lower part having a bottom end configured to reside on ballast and a top end with a horizontal surface joined to a track by means of anchorages; and an upper part (2) having a bottom end extending up from the top end of the lower part with the horizontal surface and characterized in that an upper face has two inclined surfaces in convex form, wherein the track extends up from the top end of the lower part and extends up from the bottom end of the upper part.

15. Ballast anti-flight railroad sleeper (2) according to claim 14, characterized in that the two inclined surfaces are rounded off in peak.

16. Ballast anti-flight railroad sleeper (2) according to claim 14, characterized in that the lower part and the upper part form a monolithic railroad sleeper.

17. Ballast anti-flight railroad sleeper (2) according to claims 14, characterized in that the lower part and upper part are formed by two pieces joined by means of a metallic brace.

18. Ballast anti-flight railroad sleeper (2) according to claims 14, characterized in that the lower part and upper part are formed by three or more pieces joined by means of metallic braces.

* * * * *